US008967056B2

(12) United States Patent
Apps et al.

(10) Patent No.: US 8,967,056 B2
(45) **Date of Patent: *Mar. 3, 2015**

(54) NESTABLE PALLET

(71) Applicant: Rehrig Pacific Company, Los Angeles, CA (US)

(72) Inventors: William P. Apps, Alpharetta, GA (US); Gerald R. Koefelda, Lake Bluff, IL (US); Cynthia R. Meissen, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/903,391

(22) Filed: May 28, 2013

(65) Prior Publication Data

US 2014/0000493 A1 Jan. 2, 2014

Related U.S. Application Data

(63) Continuation of application No. 13/487,991, filed on Jun. 4, 2012, now Pat. No. 8,448,583, which is a continuation of application No. 13/033,137, filed on Feb. 23, 2011, now Pat. No. 8,191,486, which is a continuation of application No. 10/340,315, filed on Jan. 9, 2003, now abandoned.

(51) Int. Cl.
*B65D 19/38* (2006.01)
*B65D 19/00* (2006.01)

(52) U.S. Cl.
CPC ..... *B65D 19/38* (2013.01); *B65D 19/0018* (2013.01); *B65D 2519/00034* (2013.01); *B65D 2519/00069* (2013.01); *B65D 2519/00273* (2013.01); *B65D 2519/00288* (2013.01); *B65D 2519/00303* (2013.01); *B65D 2519/00308* (2013.01); *B65D 2519/00318* (2013.01); *B65D 2519/00338* (2013.01); *B65D 2519/00407* (2013.01); *B65D 2519/00412* (2013.01); *B65D 2519/00557* (2013.01); *B65D 2519/00562* (2013.01); *B65D 2519/0094* (2013.01)
USPC ..... 108/57.25; 108/53.3

(58) Field of Classification Search
USPC ..... 108/57.25, 53.3, 57.26, 57.27, 57.28, 108/901, 902, 51.11, 53.1, 53.5
See application file for complete search history.

(56) References Cited

U.S. PATENT DOCUMENTS

| | | | | |
|---|---|---|---|---|
| 2,916,239 | A * | 12/1959 | Stopps | 108/53.3 |
| 5,791,262 | A * | 8/1998 | Knight et al. | 108/57.25 |
| 5,857,416 | A * | 1/1999 | Donnell et al. | 108/55.3 |
| 5,937,767 | A * | 8/1999 | Togawa et al. | 108/57.26 |
| 6,357,366 | B1 * | 3/2002 | Frankenberg | 108/57.25 |
| 6,718,888 | B2 * | 4/2004 | Muirhead | 108/57.25 |
| 6,874,428 | B2 * | 4/2005 | Apps | 108/57.25 |
| 7,165,499 | B2 * | 1/2007 | Apps et al. | 108/57.25 |
| 7,690,315 | B2 * | 4/2010 | Apps | 108/53.3 |
| 7,726,248 | B2 * | 6/2010 | Shuert | 108/57.25 |

(Continued)

*Primary Examiner* — Jose V Chen
(74) *Attorney, Agent, or Firm* — Carlson, Gaskey & Olds

(57) ABSTRACT

A nestable pallet includes a deck having an upper panel, a lower panel and a plurality of ribs extending perpendicularly from the upper panel to the lower panel. The upper panel further includes a plurality of openings for receiving feet of a similar pallet when nested. The lower panel further includes a plurality of feet extending downward from the deck, each foot having a cavity defined therein lined within one of the plurality of openings in the upper panel. Each cavity is configured to receive a foot from a similar pallet when nested therein.

14 Claims, 13 Drawing Sheets

(56) References Cited

U.S. PATENT DOCUMENTS 7,819,068 B2 * 10/2010 Apps et al. ..... 108/53.3
8,191,486 B2 * 6/2012 Apps et al. ..... 108/57.25
8,448,583 B2 * 5/2013 Apps et al. ..... 108/57.25
2005/0211139 A1 * 9/2005 Perrotta et al. ..... 108/57.25
2010/0043678 A1 * 2/2010 Linares ..... 108/57.25

* cited by examiner

NESTABLE PALLET

CROSS-REFERENCE TO RELATED APPLICATIONS

This application is a continuation of U.S. application Ser. No. 13/487,991, filed on Jun. 4, 2012, which is a continuation of U.S. application Ser. No. 13/033,137, filed on Feb. 23, 2011, which is a continuation of U.S. application Ser. No. 10/340,315, filed on Jan. 9, 2003.

BACKGROUND OF THE INVENTION

This invention relates to a nestable pallet for storing or transporting goods.

Pallets are often to used to store and transport goods. The pallets maintain the goods at a distance above the floor such that they can be readily lifted and moved by a fork of a lift truck. Some pallets have stringers or double decks forming openings which receive the forks of the lift truck. Other pallets are nestable within one another to facilitate storage and transport when empty. Generally, nestable pallets typically have openings in their upper surface which receive corresponding shaped feet of a similar nestable pallet. Thus, the nestable pallets are easier to store and transport when empty.

U.S. Pat. No. 6,283,044, assigned to the assignee of the present invention, discloses the use of box beam cross sections to provide a stronger, more durable injection molded pallet. Generally, upper and lower ribbed pallet sections are heat welded together to form the entire pallet. This patent discloses the use of box beam sections only in standard pallets, including rackable and stringer type pallets.

A nestable pallet must provide multiple openings through its deck to receive the feet of a similar pallet. As a result, box beam sections have not been provided in nestable pallets in the prior art. Therefore, prior art nestable pallets have not been able to benefit from the increased strength and durability provided by the box beam section technology.

SUMMARY OF THE INVENTION

The present invention provides the strength of box beam technology in a nestable pallet. Generally, the nestable pallet comprises a deck having an upper panel, a lower panel and a plurality of ribs extending between the panels to form box beam sections. The ribs may comprise upper rib sections extending from the upper panel that are aligned with and secured to lower rib sections extending from the lower panel. The lower panel also includes a plurality of feet each aligned with an opening through the upper panel and each having a cavity defined therein for receiving a foot from a similar pallet when nested.

The nestable pallet of the present invention provides the increased strength and durability of the box beam section in a nestable pallet. Thus, the inventive pallet has increased strength and durability in use and is also convenient to store and transport when empty.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF PREFERRED EMBODIMENTS

Figure 1:
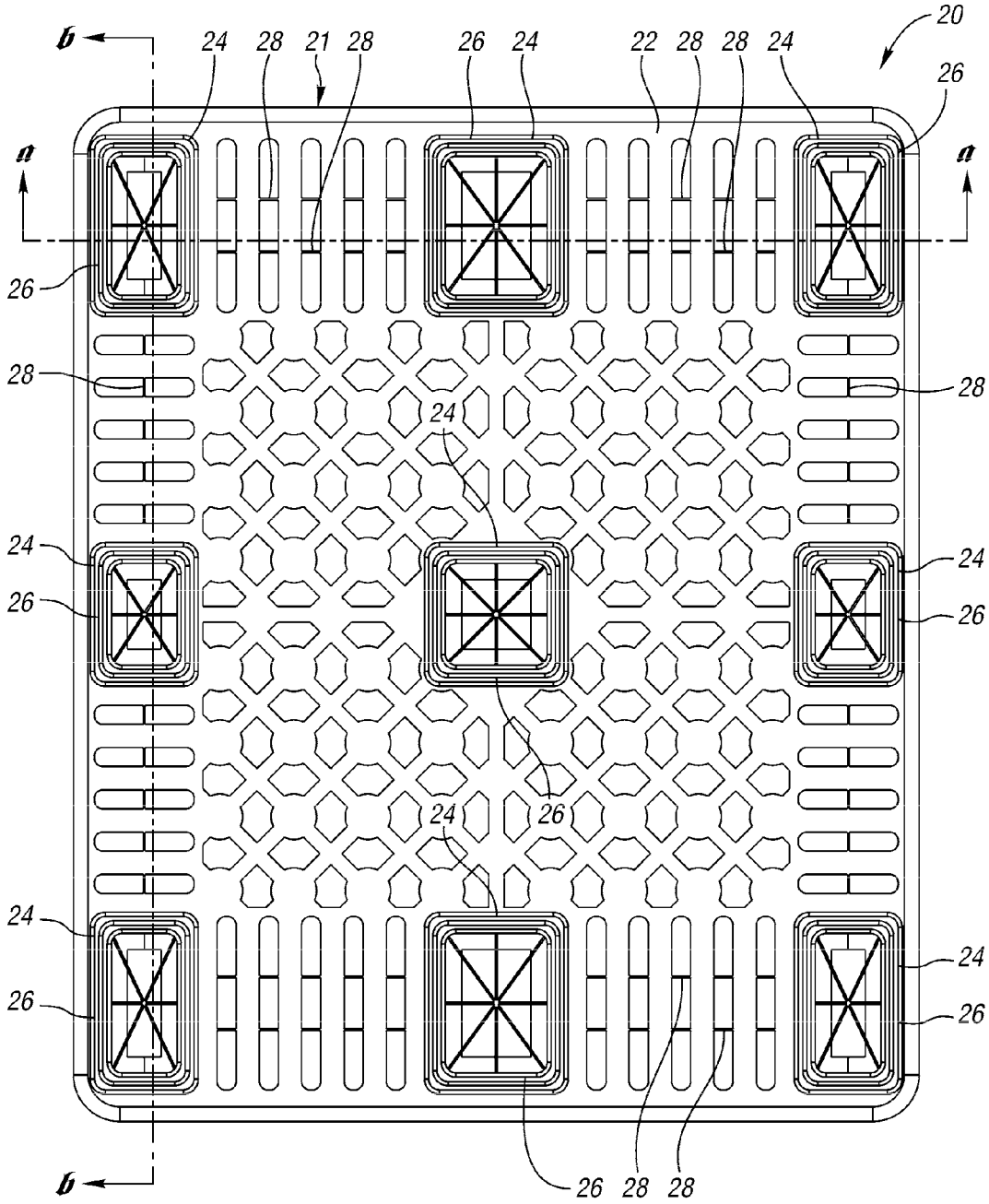
FIG. 1 is a top view of a first embodiment nestable pallet of the present invention.
Figure 2:
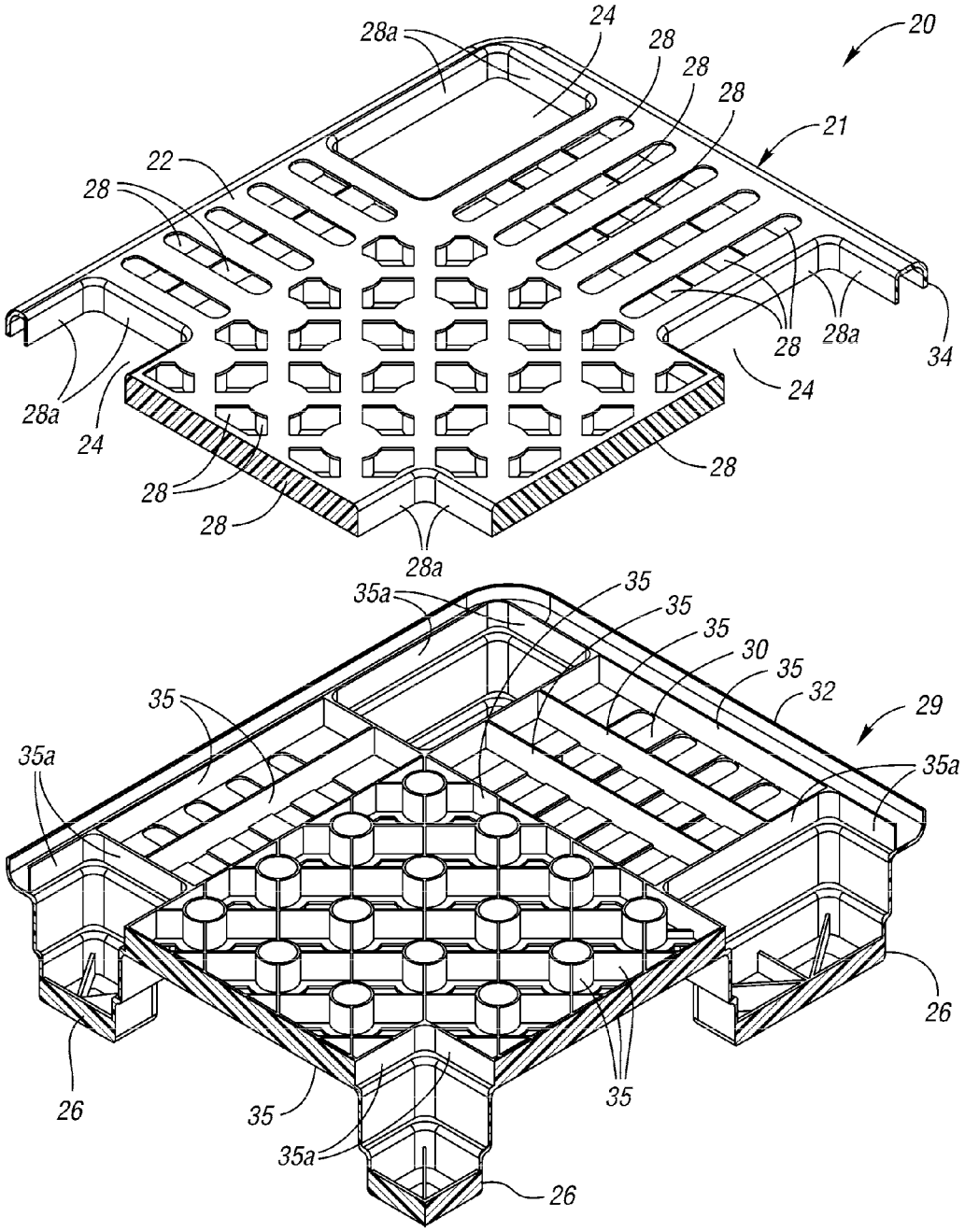
FIG. 2 is an exploded perspective view of a quarter section of the nestable pallet of FIG. 1.

A top view of a nestable pallet 20 according to the present invention is shown in FIG. 1. FIG. 2 is an exploded perspective view of the nestable pallet 20. Referring to FIGS. 1 and 2, the nestable pallet 20 includes an upper deck section 21 comprising an upper panel 22 having a plurality of openings 24 aligned with feet 26 extending downwardly from the pallet 20. The upper panel 22 further includes molded slots and drain holes. A plurality of upper rib sections 28 extend downward from the upper panel 22. At least some of the upper rib sections 28 extend between each adjacent pair of feet 26.

Referring to FIG. 2, the lower deck section 29 includes a lower panel 30 having a lip 32 about the periphery of the nestable pallet for mating with a similar lip 34 of upper panel 22. A plurality of lower rib sections 35 extend upward from the lower panel 30 in general alignment with corresponding upper rib sections 28. Some of the upper and lower rib sections 28*a*, 35*a* are aligned with and disposed on four sides of each of the openings 24 in upper panel 22 to form a portion of each of the feet 26. Each of the upper ribs sections 28 is joined to one of the lower rib sections 35, such as via hot plate welding, or other methods known in the art. The lip 34 in the upper panel 22 may be similarly joined to the lip 32 of the lower panel 30.

Figure 3A:
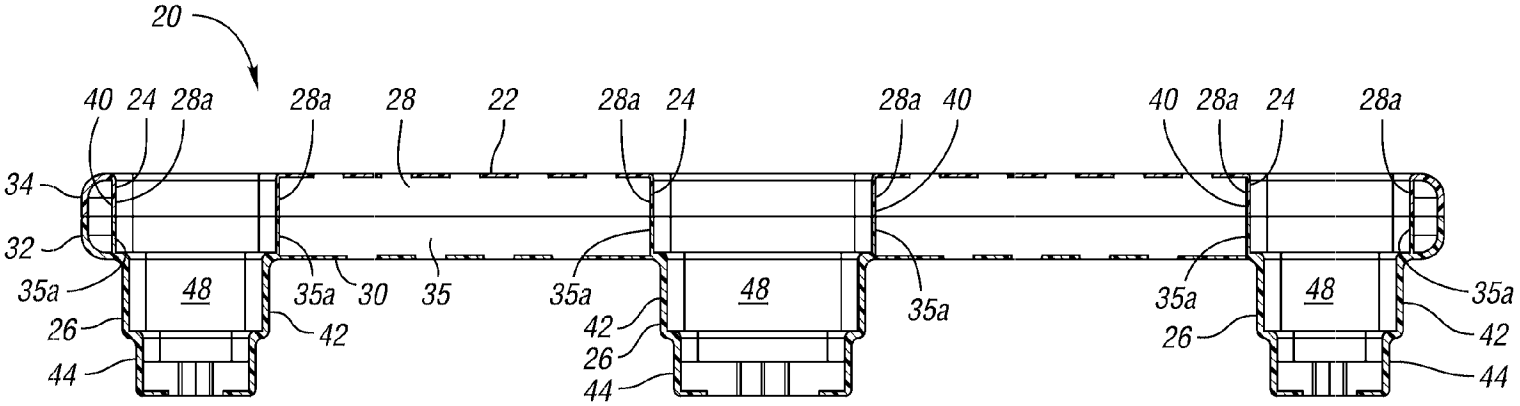
FIG. 3*a* is a sectional view through the nestable pallet of FIG. 1 along line a-a.
Figure 3B:
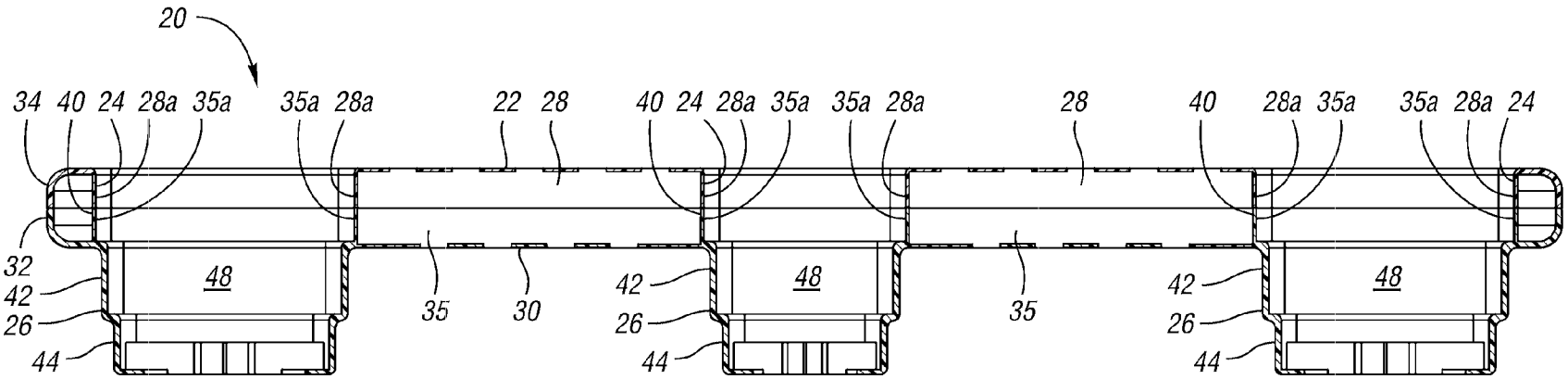
FIG. 3*b* is a sectional view of the pallet of FIG. 1 along line b-b.

FIGS. 3*a* and 3*b* are sectional views through lines a-a and b-b, respectively, of FIG. 1. As can be seen in FIGS. 3*a* and 3*b*, the lower rib sections 35 extend upward, generally perpendicularly to lower panel 30. The lower rib sections 35 are aligned with and mated to the upper ribs sections 28 in upper panel 22. The lower rib sections 35, upper rib sections 28, upper panel 22 and lower panel 29 together form a box beam cross section.

Again referring to FIGS. 3*a* and 3*b*, each of the feet 26 is tapered downwardly. In particular, each of the feet 26 includes an upper section 40, a middle section 42 and a lower section 44. Each of the sections 40, 42, 44 are concentric and decreasing in cross-sectional area with each succeeding downward section. The upper rib sections 28*a* and lower rib sections 35*a* form the upper section 40 of each of the feet 26 between upper panel 22 and lower panel 30. Load on upper panel 22 is thus transferred directly to each upper rib section 28*a*, then to an abutting lower rib section 35*a*, then to a middle section 42 of each foot 26 and then to each lower section 44 of each foot 26, thus increasing the strength of nestable pallet 20. Each opening 24 and foot 26 define a cavity 48 for receiving a corresponding foot 26 from another similar pallet 20.

Figure 4:
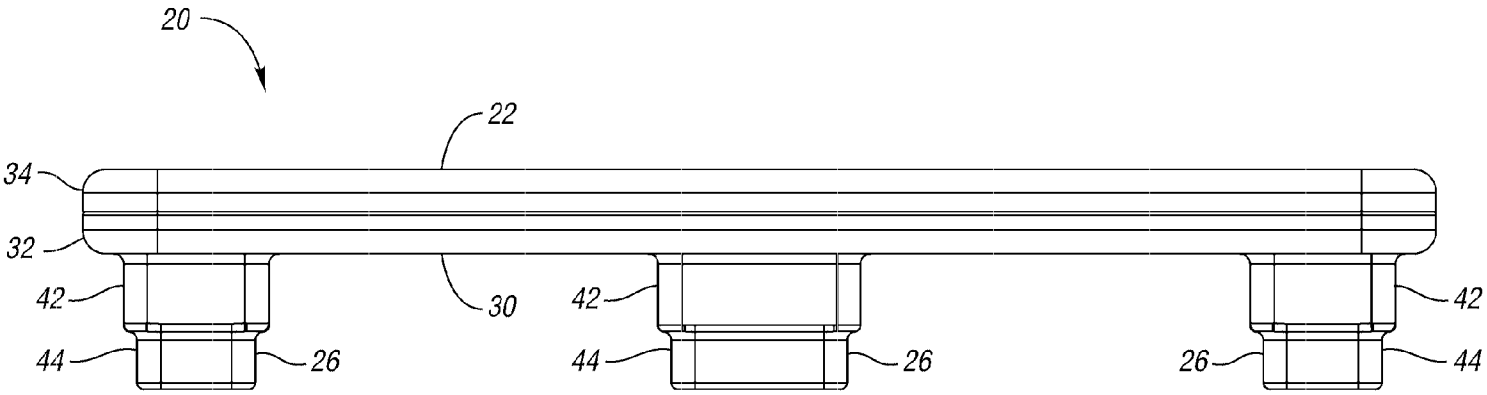
FIG. 4 is an end elevational view of the pallet of FIG. 1.
Figure 5:
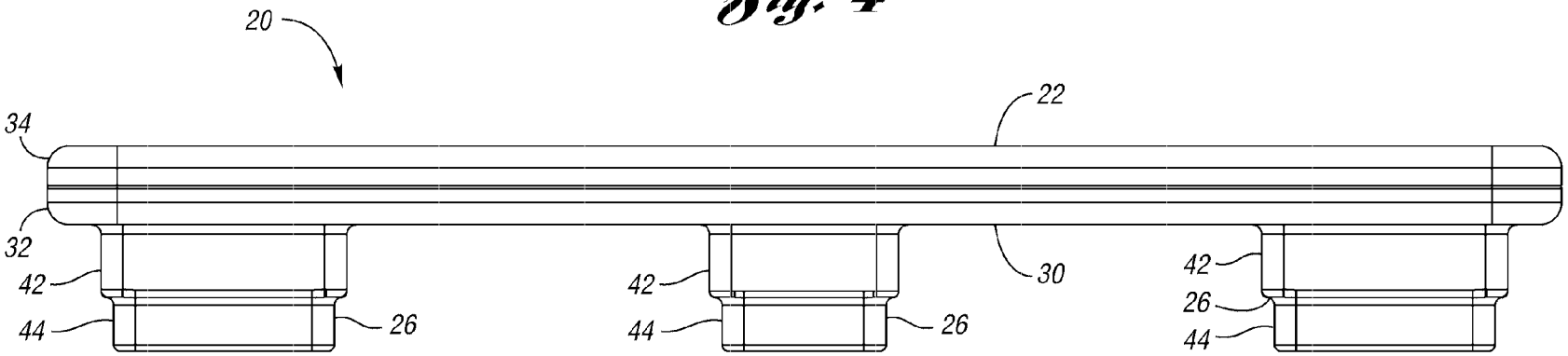
FIG. 5 is a side elevational view of the pallet of FIG. 1.
Figure 6:
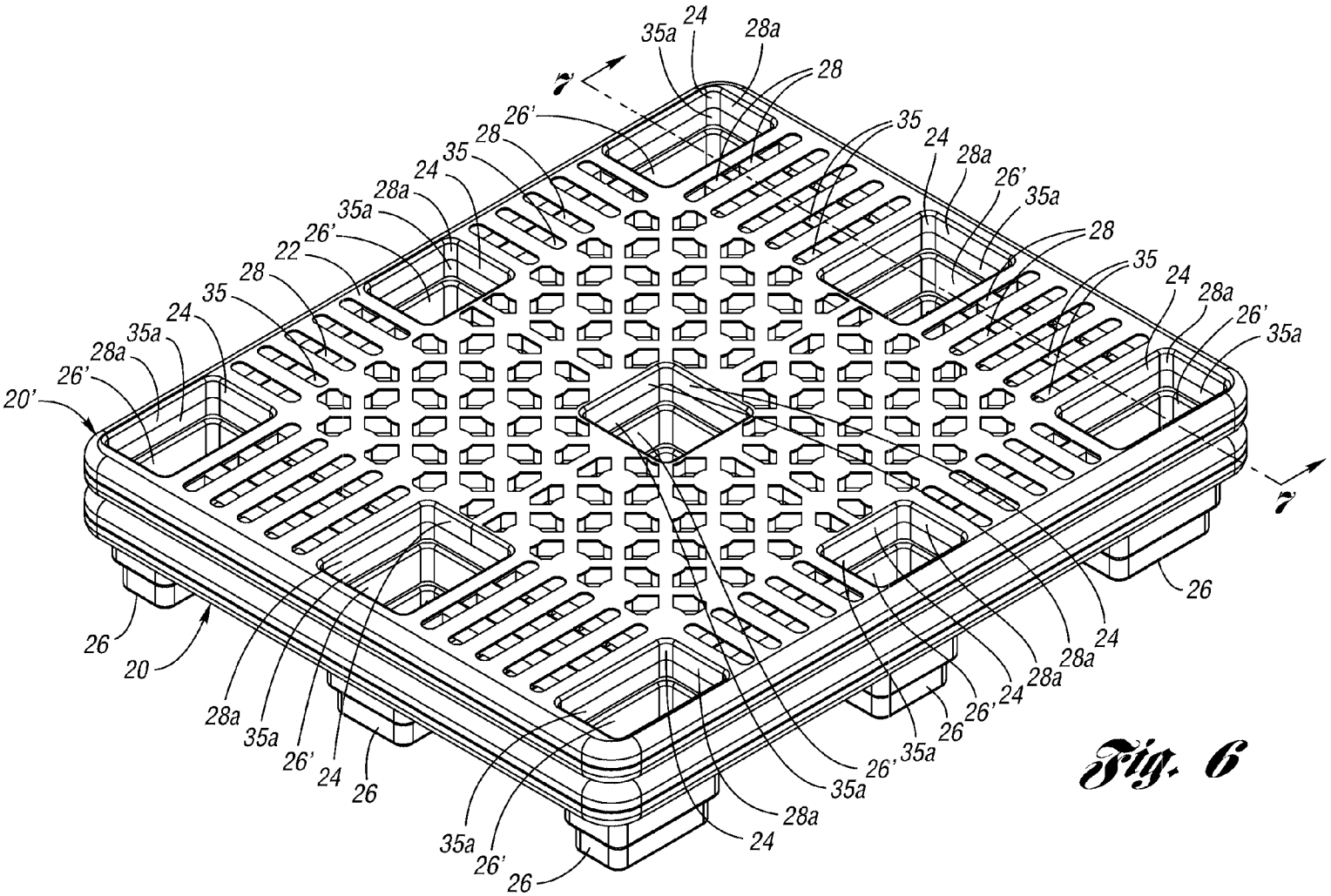
FIG. 6 is a perspective view of the pallet of FIG. 1 nested with a similar pallet.
Figure 7:
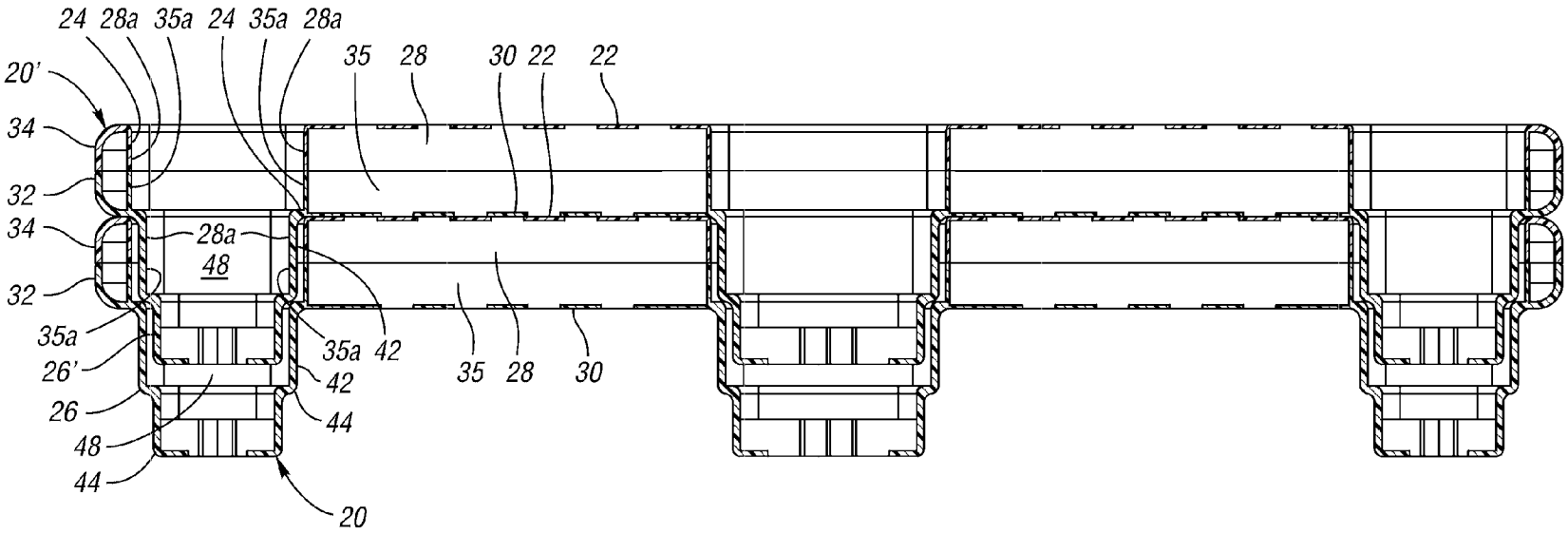
FIG. 7 is a sectional view along the line 7-7 of FIG. 6.

FIGS. 4 and 5 show an end view and a side view of the nestable pallet of FIG. 1. FIG. 6 is a perspective view of the nestable pallet 20 of FIGS. 1-5, with a similar pallet 20' nested therein, while FIG. 7 is a sectional view along lines 7-7 of FIG. 6. Referring to FIGS. 6 and 7, the feet 26' of the pallet 20' nest within the feet 26 of the pallet 20, thus reducing the overall height of the empty pallets 20, 20'.

FIGS. 8-15 show a second embodiment of a nestable pallet 120 of the present invention. The nestable pallet 120 is generally similar to that shown in the previous Figures and will thus be described more briefly. To the extent not described below or shown in the drawings to be otherwise, the nestable pallet 120 has similar structure, features and operation to those described and shown above. Generally, structure in FIGS. 8-15 corresponding to structure in FIGS. 1-7 will be referenced with the same reference numeral with the numeral "1" prepended.

Figure 8:
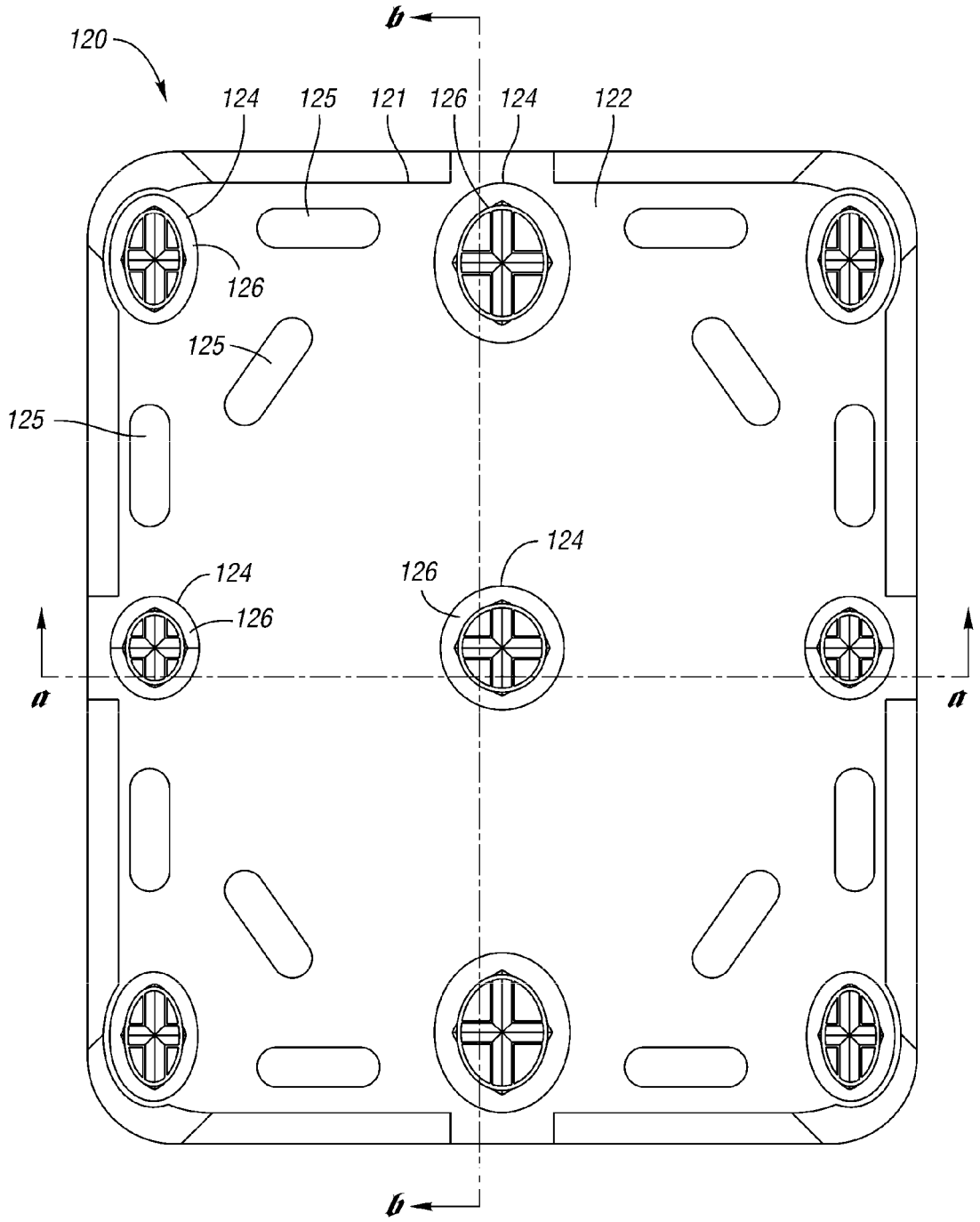
FIG. 8 is a top view of a second embodiment of the nestable pallet of the present invention.

Referring to FIG. 8, the nestable pallet 120 includes an upper deck section 121 comprising an upper panel 122 having a plurality of openings 124 aligned with feet 126 extending downwardly from the pallet 120. In this embodiment, the pallet 120 includes molded handle openings 125 through the deck sections.

Figure 9:
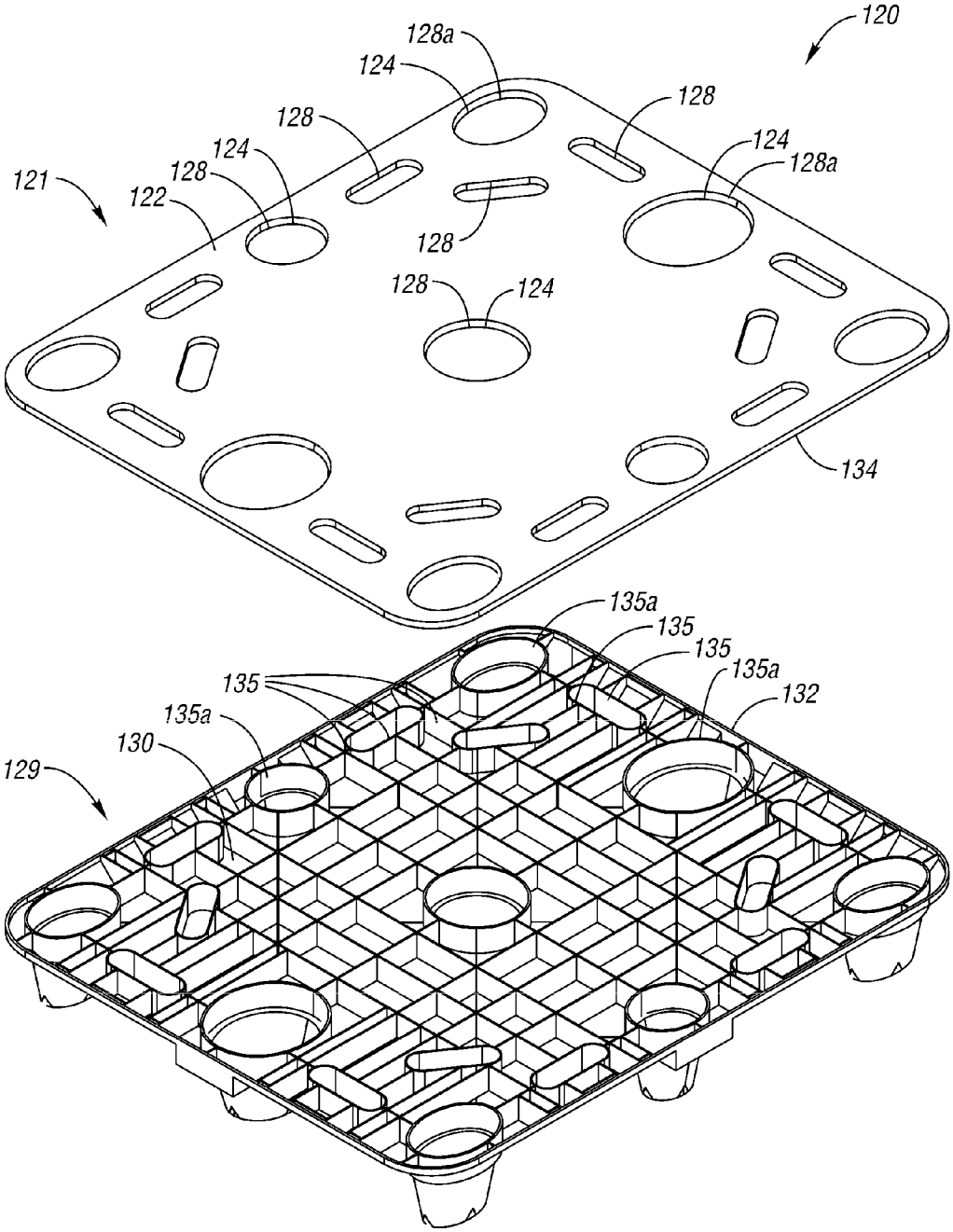
FIG. 9 is an exploded perspective view of a section of the nestable pallet of FIG. 8.

FIG. 9 is an exploded perspective view of the upper deck section 121 and a corresponding lower deck section 129. The lower deck section 129 includes a lower panel 130 having a lip 132 about its periphery for mating with a similar lip 134 of upper panel 122. The upper rib sections 128 extend downward from the upper panel 122. A plurality of lower rib sections 135 extend upward from the lower panel 130 (some between each adjacent pair of feet 26) in general alignment with corresponding upper rib sections 128. Some of the upper and lower rib sections 128*a*, 135*a* are aligned with and disposed about each of the openings 124 in upper panel 122 to form a portion of each of the feet 126.

Figure 10A:
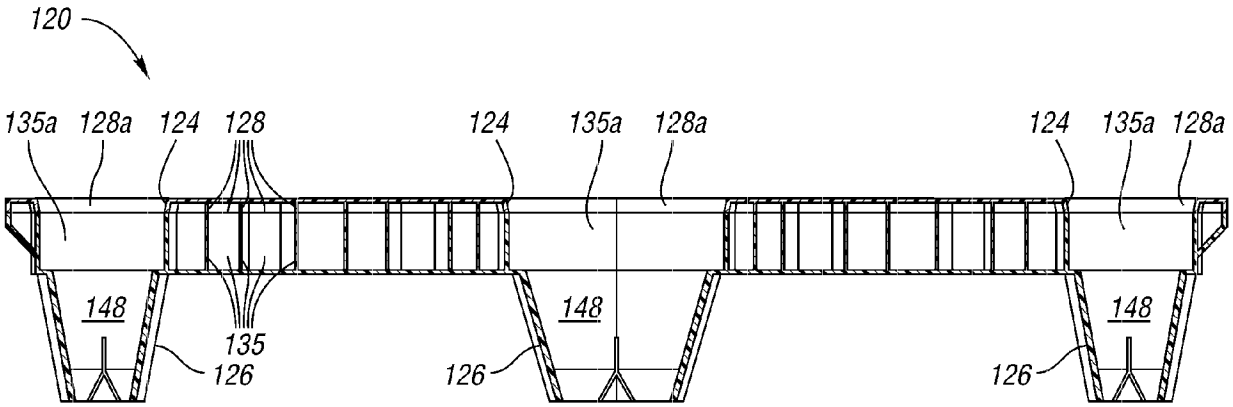
FIG. 10*a* is a sectional view through the nestable pallet of FIG. 8 along line a-a.
Figure 10B:
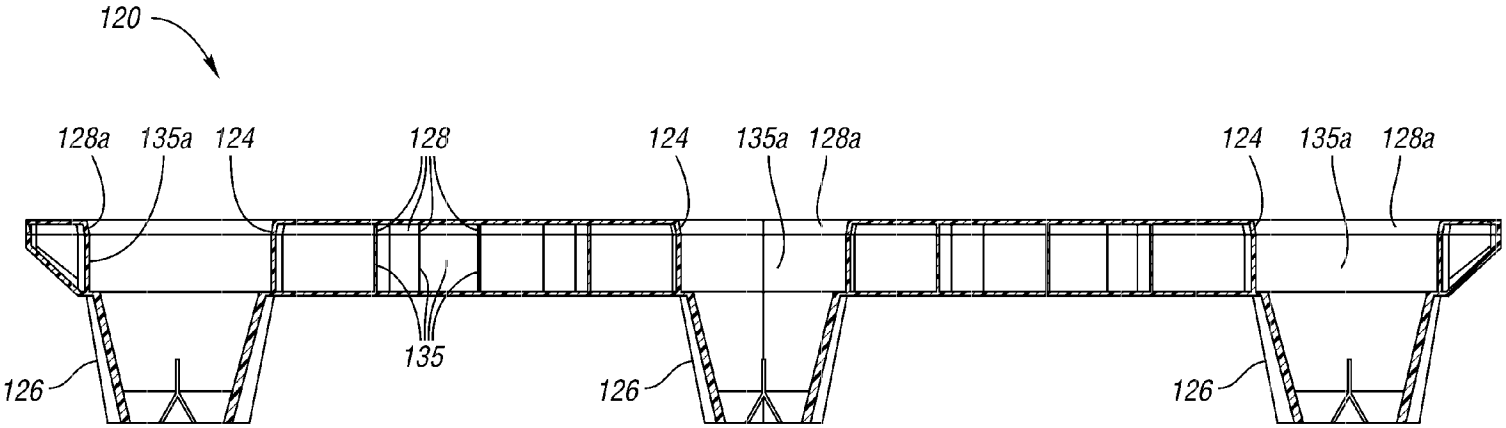
FIG. 10*b* is a sectional view of the pallet of FIG. 8 along line b-b.

FIGS. 10*a* and 10*b* are sectional views through lines a-a and b-b, respectively, of FIG. 9. As can be seen in FIGS. 10*a* and 10*b*, each of the feet 126 is tapered downwardly constantly below the lower rib sections 135*a*. Each opening 124 and foot 126 define a cavity 148 for receiving a corresponding foot 126 from another similar pallet 120.

Figure 11:
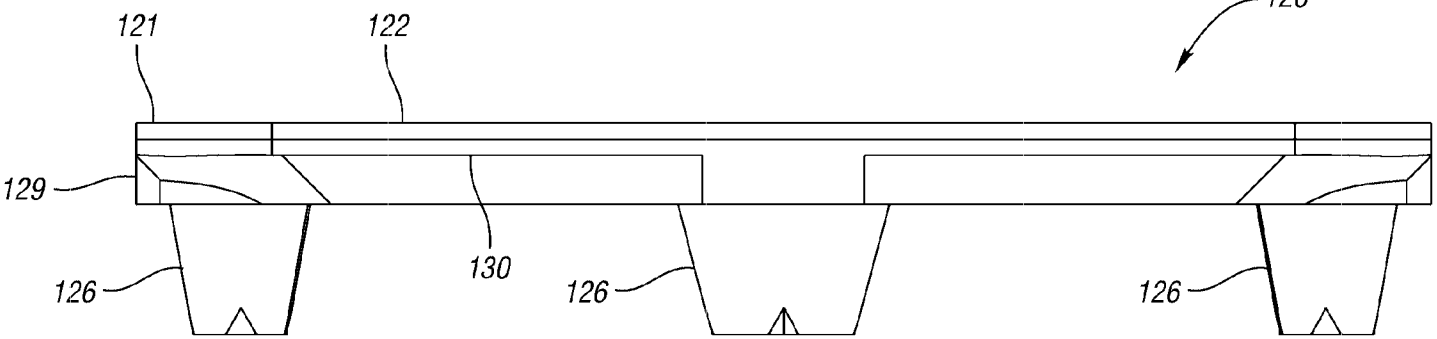
FIG. 11 is an end elevational view of the pallet of FIG. 8.
Figure 12:
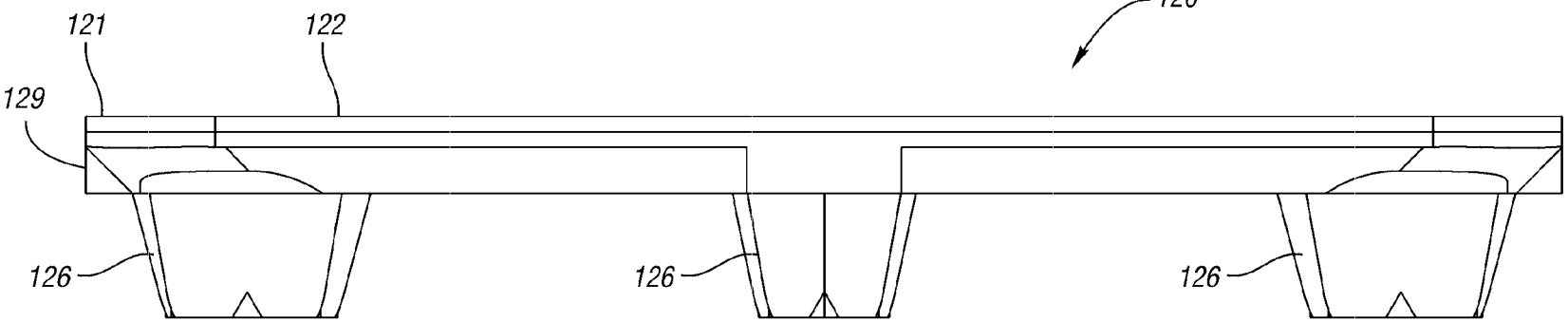
FIG. 12 is a side elevational view of the pallet of FIG. 8.
Figure 13:
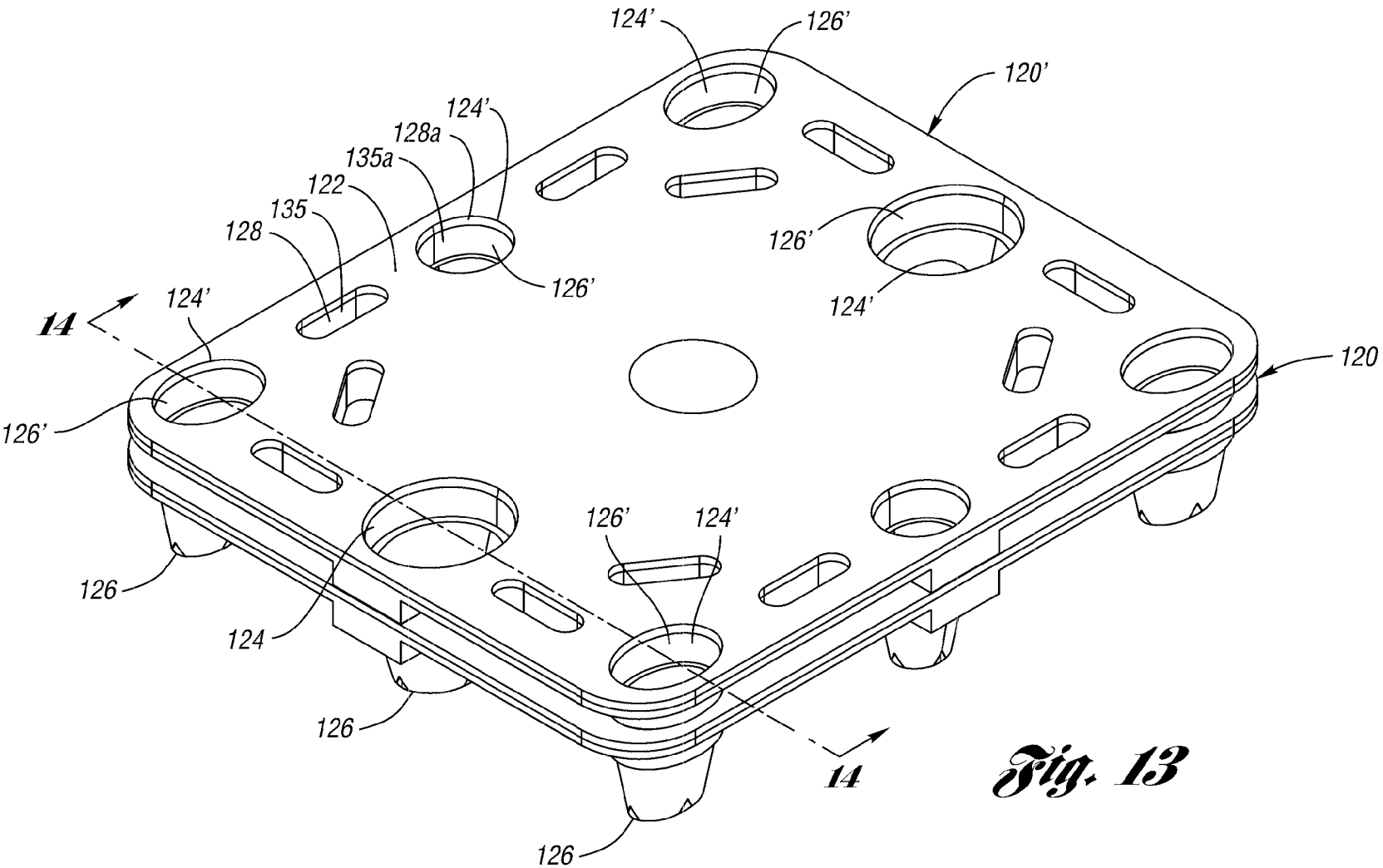
FIG. 13 is a perspective view of the pallet of FIG. 8 nested with a similar pallet.
Figure 14:
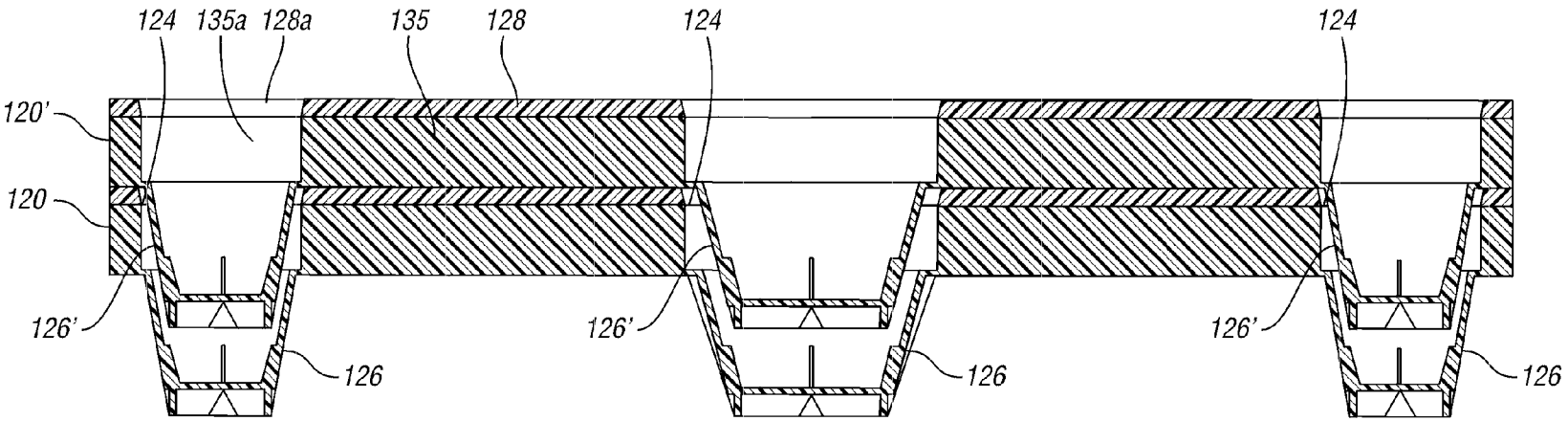
FIG. 14 is a sectional view along the line 14-14 of FIG. 13 of the nested pallets.
Figure 15:
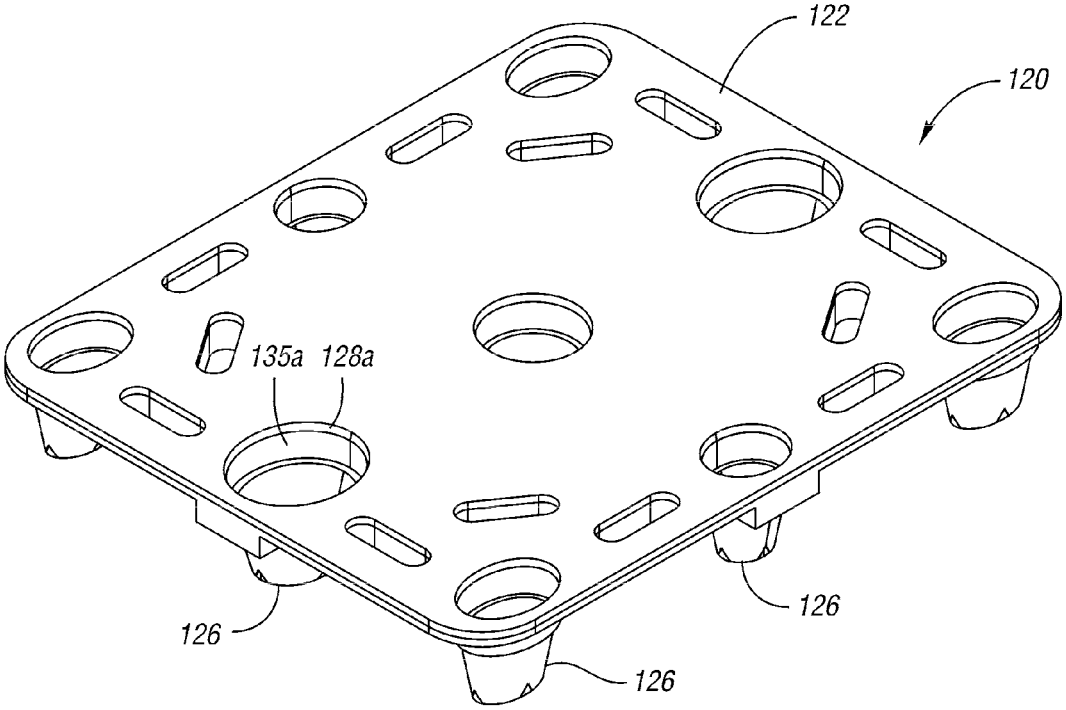
FIG. 15 is a perspective view of the nestable pallet of FIG. 8.

FIGS. 11 and 12 show an end view and a side view of the nestable pallet of FIG. 8. FIG. 13 is a perspective view of the nestable pallet 120 of FIGS. 1-5, with a similar pallet 120' nested therein, while FIG. 14 is a sectional view along lines 14-14 of FIG. 13. Referring to FIGS. 13 and 14, the feet 126' of the pallet 120' nest within the feet 126 of the pallet 120, thus reducing the overall height of the empty pallets 120, 120'.

Figure 16:
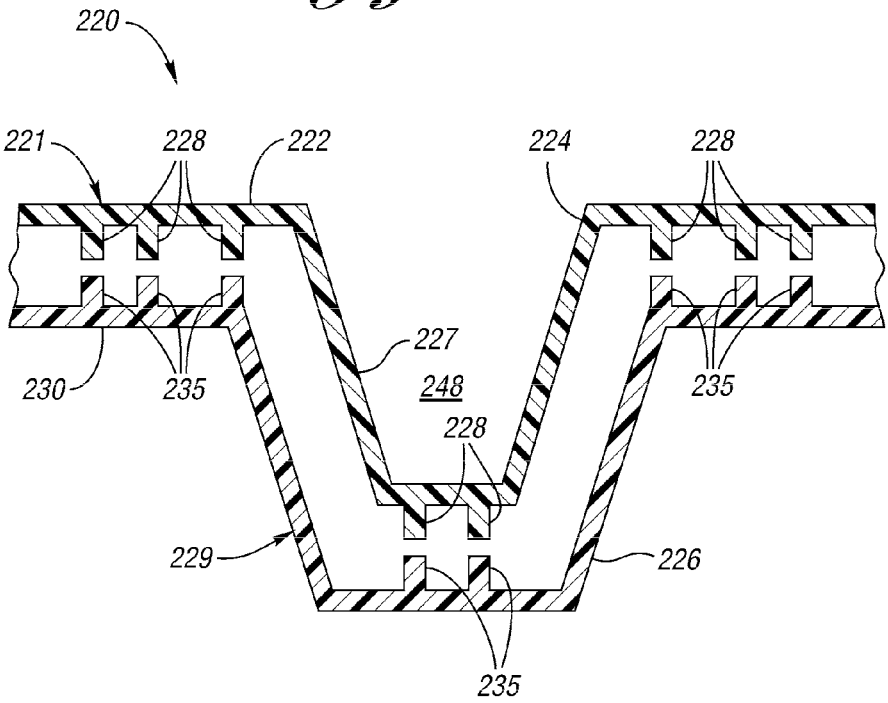
FIG. 16 is an exploded sectional view through a portion of a third embodiment of the nestable pallet of the present invention.

FIG. 16 is an exploded sectional view showing an alternate foot 226 in a third embodiment nestable pallet 220 of the present invention. In this pallet 220, the upper deck section 221 includes a downwardly projecting foot 227 extending from the upper panel 222 and aligned with the foot 226 of the lower deck section 229. The foot 227 of the upper deck section 221 includes upper rib sections 228 aligned with and mateable with lower rib sections extending upward from the foot 226 of the lower deck section 221.

The nestable pallets 20, 120, 220 of the present invention provide the increased strength and durability of the box beam section in a nestable pallet 20, 120, 220. Thus, the inventive pallet 20, 120, 220 has increased strength and durability in use and is also convenient to store and transport when empty.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are many different configurations for plastic pallets and many variations in design, many of which would benefit from the present invention. For example, the upper and lower deck sections 21, 29, 121, 129 are preferably formed of polypropylene via an injection molding process, but of course can be formed of any type of plastic applicable for the desired use. The number and arrangement of openings 24, 125, 224 and feet 26, 126, 226, 227 may vary according to the size of the pallet 20, 120, 220 and the intended application for the pallet 20, 120, 220.

What is claimed is:

1. A nestable pallet comprising:

an upper panel including a plurality of openings;

a lower panel below the upper panel, the lower panel having a peripheral lip protruding upward from the lower panel, the peripheral lip generally extending along an outer periphery of the pallet and along an outer edge of the lower panel in a first direction;

first and second feet disposed near the outer periphery, and wherein the first and second feet are generally tapered downward from the lower panel, wherein the first and second feet are aligned with two of the plurality of openings through the upper panel; and at least one rib extending upward from the lower panel to the upper panel, wherein the at least one rib extends from the first foot to the second foot in a second direction generally parallel to the first direction, wherein the peripheral lip extends upward from the lower panel the same distance as the at least one rib.

2. The nestable pallet of claim 1, wherein the peripheral lip extends around the entire pallet.

3. The nestable pallet of claim 1, wherein the first and second feet each include an upper section and a lower section having a diameter less than the upper section.

4. The nestable pallet of claim 1, wherein the at least one rib includes two ribs.

5. The nestable pallet of claim 4, wherein the at least one rib is four ribs.

6. The nestable pallet of claim 1, further including a plurality of cylindrical ribs extending between the upper panel and the lower panel.

7. The nestable pallet of claim 1, wherein the at least one rib has a single wall thickness, and wherein the at least one rib extends upward from a continuous, planar surface of the lower panel.

8. The nestable pallet of claim 7, wherein the pallet is formed by injection molding.

9. The nestable pallet of claim 1 wherein the lower panel and the first and second feet are part of a lower deck section and wherein the at first and second feet are integrally molded with the lower deck section.

10. A nestable pallet comprising:

an upper deck section including an upper panel;

a lower deck section including a lower panel below the upper panel, the lower panel having a peripheral lip generally extending along an outer edge of the pallet in a first direction, wherein the peripheral lip extends upward from the lower panel;

the lower deck section including first and second feet disposed near the outer edge, the first and second feet generally tapered downward from the lower panel;

at least one rib extending upward from the lower panel, wherein the at least one rib extends between the first and second feet in a second direction generally parallel to the first direction;

wherein the pallet is entirely defined by the upper and lower deck sections; and wherein the nestable pallet consists of the upper deck section and the lower deck section.

11. A method for manufacturing a nestable pallet including the steps of:

injection molding an upper deck section having an upper panel with a plurality of upper openings therethrough and having a plurality of upper rib sections extending downward from the upper panel;

injection molding a lower deck section having a lower panel and having a plurality of lower rib sections extending upward from the lower panel, the lower deck section further including a plurality of feet extending downward from the lower panel, the lower deck section further including a peripheral lip protruding upward from the lower panel, wherein the nestable pallet consists of the upper deck section and the lower deck section;

aligning the plurality of upper rib sections with the plurality of lower rib sections, each of the plurality of upper rib sections and each of the plurality of lower rib sections elongated along a length substantially greater than its respective height;

aligning the plurality of feet with the openings in the upper panel; and securing the upper rib sections to the lower rib sections to form a box beam section with the upper panel, lower panel, upper rib sections and lower rib sections.

12. The method of claim 11 wherein the openings in the upper panel are sized to at least partially receive the feet from an identical nestable pallet nested thereon.

13. The method of claim 11 wherein the peripheral lip extends upward from the lower panel the same distance as the plurality of lower rib sections.

14. The nestable pallet of claim 1, wherein the peripheral lip provides the outermost edge of the lower panel.

* * * * *